US010139174B2

(12) United States Patent
Keller et al.

(10) Patent No.: US 10,139,174 B2
(45) Date of Patent: Nov. 27, 2018

(54) SLIDE COVER PLATE ASSEMBLIES FOR SEMI-AUTOMATIC PISTOLS

(71) Applicant: Strike Industries, Santa Ana, CA (US)

(72) Inventors: Garrett O'Neill Keller, Santa Ana, CA (US); David Hyung Chin, Huntington Beach, CA (US)

( * ) Notice: Subject to any disclaimer, the term of this patent is extended or adjusted under 35 U.S.C. 154(b) by 0 days.

(21) Appl. No.: 15/413,263

(22) Filed: Jan. 23, 2017

(65) Prior Publication Data

US 2017/0211901 A1 Jul. 27, 2017

Related U.S. Application Data

(60) Provisional application No. 62/287,613, filed on Jan. 27, 2016, provisional application No. 62/286,845, filed on Jan. 25, 2016.

(51) Int. Cl.

| | |
|---|---|
| ***F41A 11/00*** | (2006.01) |
| ***F41A 3/66*** | (2006.01) |
| ***F41C 3/00*** | (2006.01) |
| *F41A 19/30* | (2006.01) |

(52) U.S. Cl.

CPC ..... *F41A 3/66* (2013.01); *F41A 11/00* (2013.01); *F41C 3/00* (2013.01); *F41A 19/30* (2013.01)

(58) Field of Classification Search

CPC ..... F41A 11/00; F41A 35/00; F41C 27/00; F41C 33/008

USPC ..... 42/85, 108

See application file for complete search history.

(56) References Cited

U.S. PATENT DOCUMENTS

| | | | | |
|---|---|---|---|---|
| 5,050,480 | A * | 9/1991 | Knight, Jr. | F41A 5/06 42/7 |
| 8,413,363 | B1 * | 4/2013 | Karfiol | F41A 11/00 42/106 |
| 9,285,186 | B1 * | 3/2016 | Di Veroli | F41G 1/06 |
| 9,664,471 | B1 * | 5/2017 | Curry | F41A 19/30 |
| 2001/0037596 | A1 * | 11/2001 | Salvitti | F41A 17/64 42/70.08 |
| 2004/0200109 | A1 * | 10/2004 | Vasquez | F41A 19/01 42/1.01 |
| 2011/0252686 | A1 * | 10/2011 | Coleman | F41A 15/10 42/25 |
| 2013/0000173 | A1 * | 1/2013 | Green | F41A 17/64 42/70.11 |
| 2015/0184966 | A1 * | 7/2015 | Beck | F41A 17/64 42/70.08 |

(Continued)

*Primary Examiner* — Derrick R Morgan

(57) ABSTRACT

Slide cover plate assemblies for accessing internal components housed within a slide of a pistol in accordance with various embodiments of the invention are disclosed. In one embodiment, a slide cover plate assembly for accessing internal components housed within a slide of a pistol, includes a first plate having an opening to mate with a button of a second plate, the first plate includes at least one contact portion and a mating portion, where the mating portion is in contact with the slide, the second plate includes the button, a corresponding contact portion, and an interior face, where the interior face receives a force exerted by a firing pin spring housed within the slide, and where the button receives a manual pressure applied by an operator, where the received manual pressure counteracts the force exerted by the firing pin allowing the slide cover plate assembly to disengage from the slide.

20 Claims, 14 Drawing Sheets

(56) References Cited

U.S. PATENT DOCUMENTS

2016/0040957 A1* 2/2016 Finsand ..... F41C 33/008
224/269

* cited by examiner

SLIDE COVER PLATE ASSEMBLIES FOR SEMI-AUTOMATIC PISTOLS

CROSS-REFERENCE TO RELATED APPLICATIONS

This current application claims priority to U.S Provisional Patent Application No. 62/286,845 filed Jan. 25, 2016 and U.S. Provisional Patent Application No. 62/287,613 filed Jan. 27, 2016, the disclosures of which are incorporated herein in their entirety by reference.

FIELD OF THE INVENTION

The present invention generally relates to firearms and more specifically to slide cover plate assemblies for accessing internal components of a semi-automatic pistol.

BACKGROUND

Semi-automatic pistols (may also be referred to as "pistols") should be maintained to ensure consistent performance and a longer operational life. Semi-automatic pistols should be routinely cleaned and lubricated to prevent corrosion and to remove debris that can adversely affect the functionality and value of the pistol. Though various pistols such as (but not limited to) the Glock pistol, may be designed to be highly resistant to unfavorable and rough environments, an operator should follow a regularly scheduled maintenance routine. Further, every time a pistol is cleaned, it should be field stripped and disassembled into its major components. Cleaning without properly disassembling the pistol, for example by merely locking the slide to the rear and inserting a cleaning rod through the bore, can trap grime, oil, and solvents inside the pistol, causing performance issues and malfunctions.

SUMMARY

The various embodiments of the present slide cover plate assemblies have several features, no single one of which is solely responsible for their desirable attributes. Without limiting the scope of the present embodiments as expressed by the claims that follow, their more prominent features will now be discussed below. After considering this discussion, and particularly after reading the section entitled "Detailed Description," one will understand how the features of the present embodiments provide the advantages described here.

One aspect of the present embodiments includes the realization that, in current slide cover plates other than the present embodiments, in order to access the internal components housed within the slide of a pistol, an operator must use tools to remove the slide cover plates to gain access to the internal components. Typically, slide cover plates are located at the rear portion of the slide and held in place via spring tension (may also be referred to as "force") from a compressed firing pin spring within. The cover plate must be removed to gain access to the firing pin and extractor components. With present slide cover plates other than the present embodiments, removing the cover plate from the slide can be a tedious process requiring tools. Using tools such as a bladed screw driver may cause cosmetic damage to the plate or the firearm. Further, tools may not always be on hand. In addition, an operator may need to inspect or clean a pistol quickly or while on the go. Therefore, there is a need in the firearms industry for a pistol slide cover plate that can be removed without tools.

Slide cover plate assemblies and methods for accessing internal components housed within a slide of a pistol in accordance with embodiments of the invention are disclosed. In one embodiment, a slide cover plate assembly for accessing internal components housed within a slide of a pistol, includes a first plate having an opening to mate with a button of a second plate, the first plate includes at least one contact portion and a mating portion, where the mating portion is in contact with the slide, the second plate includes the button, a corresponding contact portion, and an interior face, where the interior face receives a force exerted by a firing pin spring housed within the slide, where the contact portion of the first plate is in contact with the corresponding contact portion of the second plate allowing the second plate to transfer the force exerted by the firing pin to the first plate, where the mating portion of the first plate in contact with the slide uses the force transferred to the first plate from the second plate to engage the slide cover plate with the slide, and where the button receives a manual pressure applied by an operator, where the received manual pressure counteracts the force exerted by the firing pin allowing the slide cover plate assembly to disengage from the slide.

In a further embodiment, the interior face of the second plate is in contact with a spacer sleeve housed within the slide In another embodiment, the interior face receives the force exerted by the firing pin spring from the spacer sleeve housed within the slide.

In a still further embodiment, the button of the second plate protrudes above an exterior face of the first plate when the slide cover plate is engaged with the slide.

In still another embodiment, the first plate also includes a first clearance slot that allows the slide to move about a frame of the pistol.

In a yet further embodiment, the first plate also includes a second clearance slot that allows the slide to move about the frame of the pistol.

In yet another embodiment, the mating portion of the first plate is a groove and makes contact with a corresponding groove of the slide.

In a further embodiment again, the opening includes a first opening and a second opening.

In another embodiment again, the button includes a first button and a second button.

In a further additional embodiment, the first and second openings mate with the first and second buttons, respectively.

A further embodiment includes a method for accessing internal components housed within a slide of a pistol using a slide cover plate assembly, the method includes mating an opening of a first plate with a button of a second plate, receiving a force exerted by a firing pin spring housed within the slide using an interface face of the second plate, transferring the force exerted by the firing pin from the second plate to the first plate using a contact portion of the first plate in contact with a corresponding contact portion of the second plate, engaging the slide cover plate assembly with the slide using a mating portion of the first plate, where the mating portion is in contact with the slide and engages the slide cover plate assembly with the slide using the force transferred to the first plate from the second plate, and receiving a manual pressure applied by an operator using the button of the second plate, where the received manual pressure counteracts the force exerted by the firing pin allowing the slide cover plate assembly to disengage from the slide.

In a still yet further embodiment, the interior face of the second plate is in contact with a spacer sleeve housed within the slide.

In still yet another embodiment, the interior face receives the force exerted by the firing pin spring from the spacer sleeve housed within the slide.

In a still further embodiment again, the button of the second plate protrudes above an exterior face of the first plate when the slide cover plate is engaged with the slide.

In still another embodiment again, the first plate also includes a first clearance slot that allows the slide to move about a frame of the pistol.

In a still further additional embodiment, the first plate also includes a second clearance slot that allows the slide to move about the frame of the pistol.

In still another additional embodiment, the mating portion of the first plate is a groove and makes contact with a corresponding groove of the slide.

In a yet further embodiment again, the opening includes a first opening and a second opening.

In yet another embodiment again, the button includes a first button and a second button.

In a yet further additional embodiment, the first and second openings mate with the first and second buttons, respectively.

DETAILED DESCRIPTION OF THE DRAWINGS

Turning now to the drawings, slide cover plate assemblies for accessing internal components housed within a slide of a pistol in accordance with embodiments of the invention are described. In many embodiments, slide cover plate assemblies may include a first plate and a second plate configured to allow an operator to apply manual pressure (i.e. force) to disengage the slide cover plate assembly from the rear of the slide. In various embodiments, the second plate may be configured to receive force exerted by a compressed firing pin spring, where the force exerted by the firing pin spring keeps the slide cover plate assembly engaged to the slide as further described below. In several embodiments, the operator may apply manual pressure to a button of the second plate to counteract the force applied by the firing pin spring and allow the slide cover plate assembly to disengage from the slide. Once the slide cover plate is disengaged and removed, an operator may access the internal components housed within the slide such as (but not limited to) a firing pin, firing pin spring, spacer sleeves, spring cups and/or extractor components. Slide cover plate assemblies in accordance with embodiments of the invention are described further below.

Slide Cover Plate Assemblies

Figure 1A:
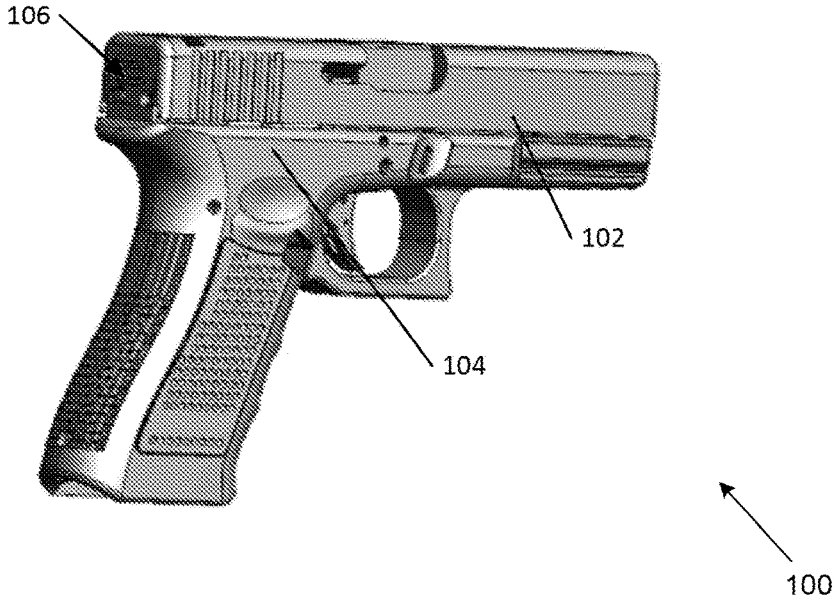
FIG. 1A is a perspective view of a pistol having a slide cover plate assembly in accordance with an embodiment of the invention.

Slide cover plates assemblies may cover an opening in the rear of a slide and be held in place via spring tension (i.e. force) from a compressed firing pin spring. In order to properly access and maintain the internal components, an operator may remove the slide cover plate assembly by applying manual pressure. A perspective view of a pistol having a slide cover plate assembly in accordance with an embodiment of the invention is shown in FIG. 1A. A pistol 100 may include a slide 102 that is attached to a frame 104. During operation of the pistol 100, the slide 102 moves along the frame 104 where the energy of a fired cartridge cycles the action of the pistol 100 and advances the next available cartridge into position for firing. In many embodiments, the rear of the slide 102 may be covered by a slide cover plate assembly 106 configured to allow an operator to remove the slide cover plate assembly using manual pressure as further described below. Once the slide cover plate assembly is removed, the operator may gain access to the various internal components (not illustrated) housed within the slide 102.

Figure 1B:
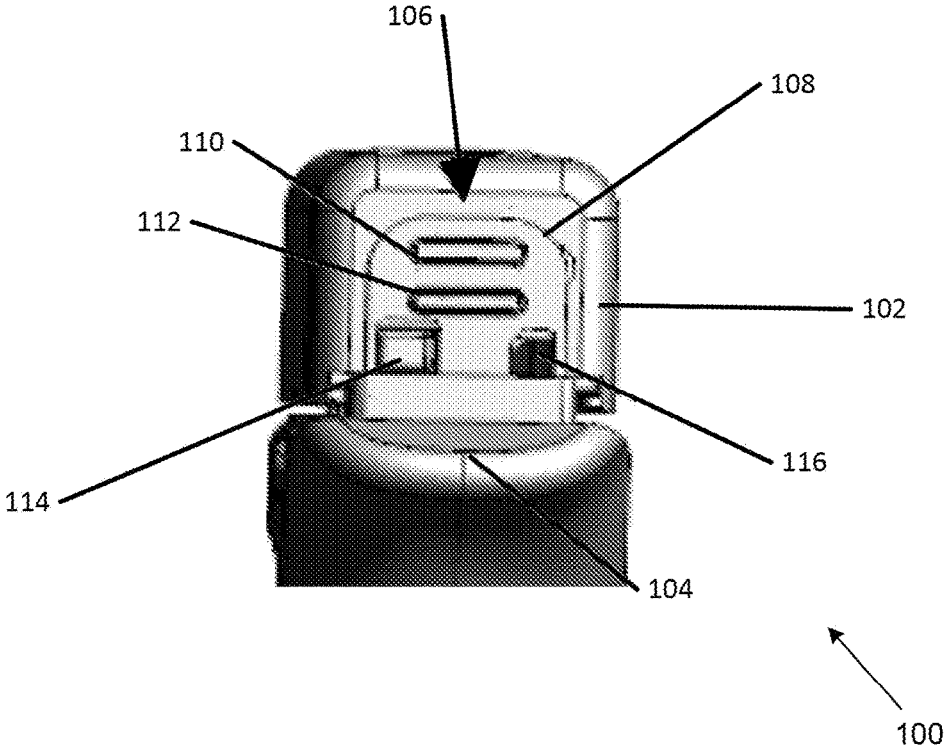
FIG. 1B is a rear side view of a pistol having a slide cover plate assembly in accordance with an embodiment of the invention.

A rear side view of a pistol having a slide cover plate assembly in accordance with an embodiment of the invention is shown in FIG. 1B. In many embodiments, the slide cover plate assembly 106 may include a first plate 108 configured to cover the rear of the slide 102 as further described below. In various embodiments, the slide cover plate assembly 106 may include a second plate having a first button 110 and a second button 112, configured to receive manual pressure from an operator to disengage the slide cover plate assembly 106 as further described below. In several embodiments, the slide cover plate assembly may also include a first clearance notch 114 and a second clearance notch 116 that allows the slide 102 to move along the frame 104 when the pistol is in operation.

Figure 2A:
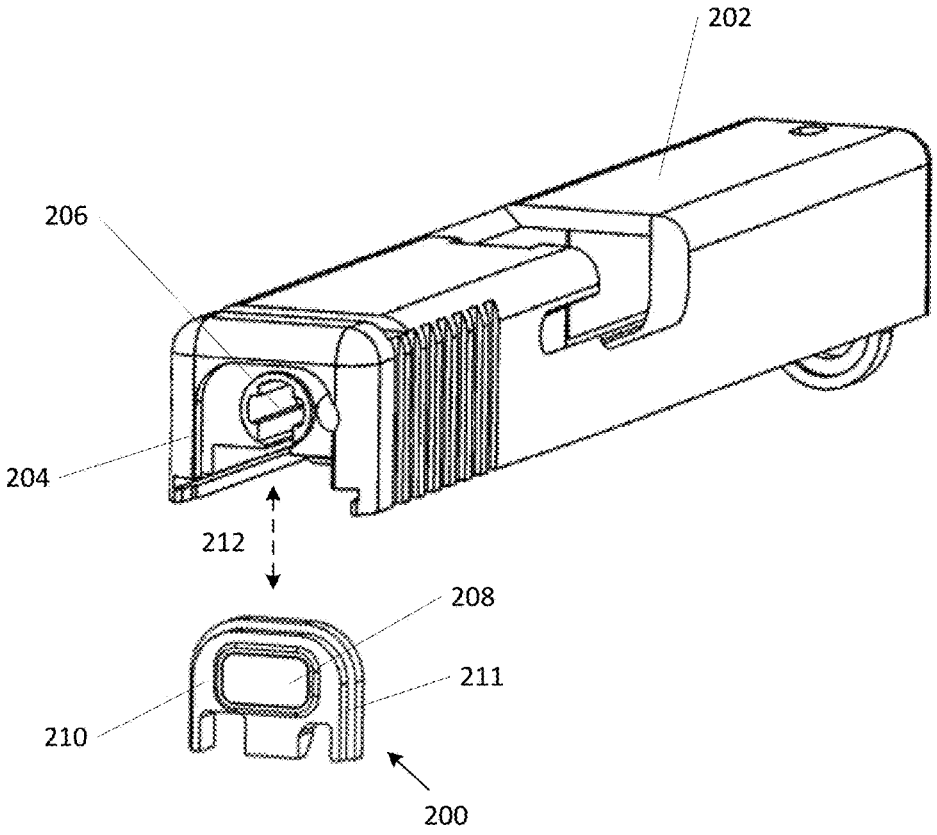
FIG. 2A is a schematic diagram illustrating a slide cover plate assembly disengaged from a slide in accordance with an embodiment of the invention.

A schematic diagram illustrating a slide cover plate assembly disengaged from a slide in accordance with an embodiment of the invention is illustrated in FIG. 2A. The slide cover plate assembly 200 may include a first plate 210 and a second plate 208 configured to engage and disengage with a slide 202 of a pistol. In many embodiments, the slide cover plate assembly 200 may be placed into (i.e. engaged) and/or pulled out (i.e. disengaged) from the slide 202 along a path 212. To engage the slide cover plate assembly 200 with the slide 202, the first plate 210 may include a mating portion such as (but not limited to) a groove 211 configured to mate with a corresponding groove 204 of the slide 202.In various embodiments, the shape of the groove 204 of a particular slide 202 may determine the shape of the groove 211 of the first plate 210. When the slide cover plate assembly is engaged with the slide 202, the internal components housed within the slide 202 are kept within the slide 202. In a variety of embodiments, the slide cover plate assembly 200 may be disengaged from the slide 202 by an operator exerting manual pressure onto the second plate 208 as further described below. Once the slide cover plate assembly 200 is disengaged, an internal component such as (but not limited to) a spacer sleeve 206 may be exposed and pulled out from rear of the slide 202as further described below. Thus, when disengaged, the operator may access the internal components housed within the slide 202 for maintenance.

Figure 2B:
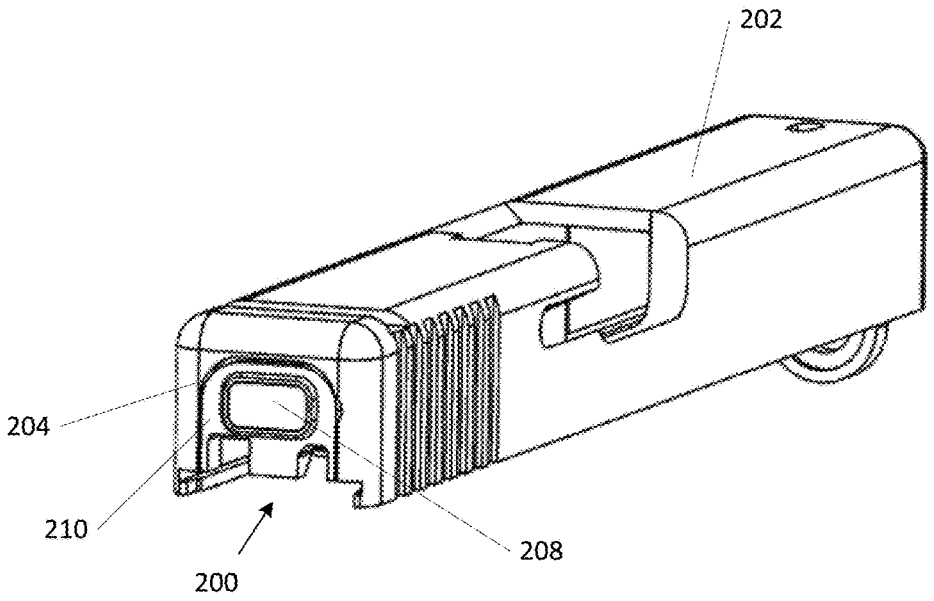
FIG. 2B is a schematic diagram illustrating a slide cover plate assembly engaged to a slide in accordance with an embodiment of the invention.

A schematic diagram illustrating a slide cover plate assembly engaged to a slide in accordance with an embodiment of the invention is shown in FIG. 2B. As described above, the slide cover plate assembly 200 may be engaged to the rear of the slide 202 along the path 212 as illustrated in FIG. 2A. In various embodiments, the first plate 210 may move along the groove 204 until the slide cover plate assembly 200 is engaged with the slide 202. Typically, the slide cover plate assembly 200 is fully engaged when there is no space between the first plate 210 and the groove 204. In a variety of embodiments, the second cover plate 208 may include an exterior side having a button and an opposite interior side having an interior face, where the interior face is configured to receive the force exerted by the firing pin spring as further described below. In many embodiments, the firing pin spring exerts force onto the spacer sleeve 206, where the spacer sleeve 206 is in direct contact with the interior face of the second plate 208. In other embodiments, the firing pin spring may exert force onto the interior face of the second plate 208 either directly or via some other internal component other than the spacer sleeve 206.

In further reference to FIGS. 2A and 2B, to engage the slide cover plate assembly 200 with the slide 202, the firing pin spring may be compressed before the slide cover plate assembly is allowed to engage with the slide 202. In many embodiments, the second plate 208 and the first plate 210 may be configured where the force exerted onto the second plate 208 by the firing pin spring is transferred from the second plate 208 to the first plate 210 via at least one corresponding contact portions allowing the slide cover plate assembly 200 to retain its engaged position with the slide 202 as further described below. For example, in some embodiments, the mating portion 211 of the first plate 210 may be in contact with the slide and use the force transferred to the first plate 210 from the second plate 208 to engage the slide cover plate assembly 200 with the slide 202. To disengage the slide cover plate assembly 200 from the slide 202, the operator may apply pressure to the button of the second plate 208 thereby further compressing the firing pin spring and counteracting the force being exerted by the firing pin spring onto the first plate 210 via the second plate 208 and thus allowing the slide cover plate assembly 200 to be disengaged from the slide 202 along the path 212. In various embodiments, the second plate 208 does not make contact with the slide 202 and the first plate 210 does not make contact with the spacer sleeve 206.

Although specific slide cover plate assemblies having a first plate and a second plate are discussed above, any of a variety of slide cover plate assemblies including those where the first and second plates are conjoined and fitted as a single unit as appropriate to the requirements of a specific application can be utilized in accordance with embodiments of the invention. First and second plates for slide cover plate assemblies in accordance with embodiments of the invention are discussed further below.

Internal Components Housed Within a Slide

Figure 3A:
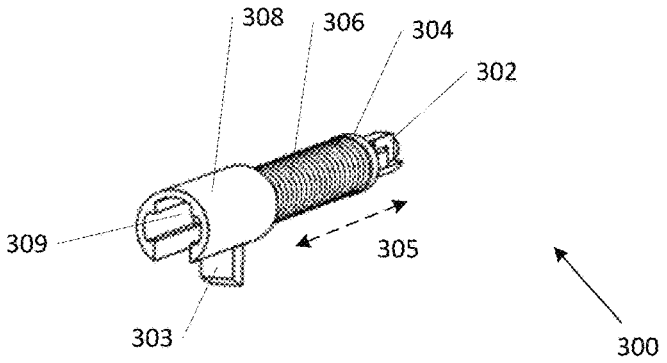
FIGS. 3A-C are schematic diagrams illustrating internal components of a slide cover plate assembly in accordance with an embodiment of the invention.

A firing pin spring is typically compressed into place when the internal components are housed within a slide of a pistol. The compressed firing pin spring may thus exert a force to return to its uncompressed state. A schematic diagram illustrating internal components housed within a slide of a pistol in accordance with an embodiment of the invention is illustrated in FIG. 3A. The internal components 300 may be housed within a slide and include a firing pin 302, a firing pin spring 306, spring cups 304, and a spacer sleeve 308.In many embodiments, the spacer sleeve 308 may have a hollow cavity 309 with a stop, where the stop engages a portion 303 of the firing pin 302 such that the firing pin 302 can release from the spacer sleeve 308 in only one direction along the axis of the force 305. Further, the firing pin spring 306 may coil around the firing pin 302. In various embodiments, the firing pin spring 306 may contact the spring cups 304 on one side and contact the spacer sleeve 308 on the opposite side. In a variety of embodiments, when the firing pin spring 306 is compressed, the forces305 push outward from the center of the firing pin spring 306 towards the spring cups 304 and towards the spacer sleeve 308. Typically, the side with the spring cups 304 may be held in place and thus the firing pin spring 306 pushes the spacer sleeve 308 away from the spring cups 304 and toward the rear of the slide.

Figure 3B:
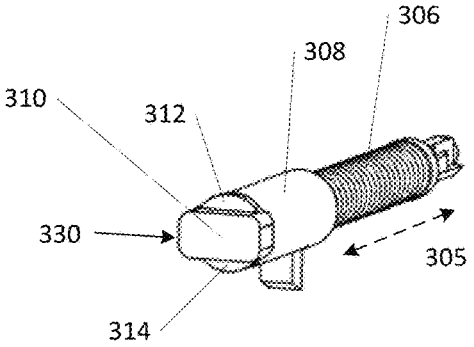

A schematic diagram illustrating a second plate attached to the internal components in accordance with an embodiment of the invention is shown in FIG. 3B. In many embodiments, the second plate 330 may include an interior side having an interior face that is in contact with the spacer sleeve 308 such that the force 305 applied onto the spacer sleeve 308 from the firing pin spring 306 is applied to the interior face of the second plate 330 as further described below. In several embodiments, the second plate 330 may also include an exterior side having a button 310 configured to receive manual pressure from an operator. In a variety of embodiments, the second plate 330 may also include a first contact portion 312 and a second contact portion 314 configured to make contact with corresponding contact portions on a first plate as further described below.

Figure 3C:
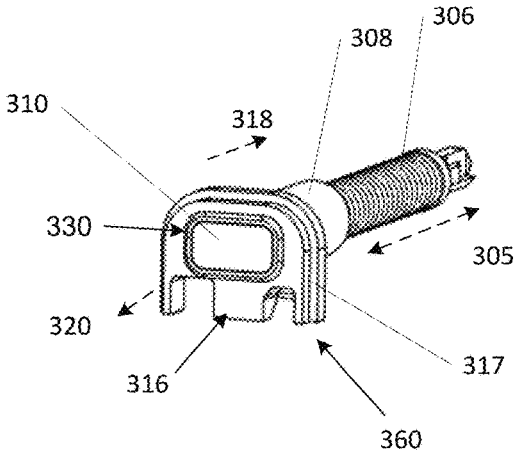

A schematic diagram illustrating a slide cover plate assembly attached to the internal components in accordance with an embodiment of the invention is shown in FIG. 3C. In various embodiments, the slide cover plate assembly 360 may include a first plate 316 mated with a second plate 330. As discussed above, the second plate 330 may be in contact with the spacer sleeve 308 such that the force 305 applied onto the spacer sleeve 308 from the firing pin spring 306 is applied to the second plate 330. In many embodiments, the first contact portion 312 and the second contact portion 314 of the second plate are in contact with the first plate 316 such that the force 305 can be transferred from the second plate to the first plate as further described below. In several embodiments, the force applied to the first plate may be used to keep the slide cover plate assembly engaged to the slide.

When the slide cover plate assembly is engaged, the grooves 317 of first plate 316 may mate with grooves (see 204 in FIGS. 2A and 2B) of the rear portion of a slide such that force 320 is applied from the first plate 316 to the grooves of the slide, and thereby maintain the slide cover plate assembly 360 engaged to the slide. To disengage the slide cover plate assembly 360, manual pressure 318 may be applied to the button 310 of the second cover plate 330. In many embodiments, the applied force 318 moves the second plate 330 away from the first plate 316 and pushes the spacer sleeve 308 and further compresses the firing pin spring 306. By moving the second plate 310 away from the first plate 316 and counteracting the force 305, the force 320 is also alleviated and the first plate 316 may be slid along the grooves of the rear portion of the slide and thereby be disengaged the slide cover plate assembly 360 from the slide. As described above, the internal components 300 housed within a slide of a pistol may then be accessed for maintenance using the manual pressure from the operator to remove the slide cover plate assembly.

Although specific internal components and slide cover plate assemblies are discussed above with respect to FIGS. 3A-C, any of a variety of internal components including (but not limited to) those not including a spacer sleeve where force from a compressed firing pin spring acts directly onto a second plate of a slide cover plate assembly as appropriate to the requirements of a specific application can be used in accordance with embodiments of the invention. Various slide cover plate assemblies having a first plate and a second plate in accordance with embodiments of the invention are discussed further below.

Various First and Second Plate Configurations

Figure 4A:
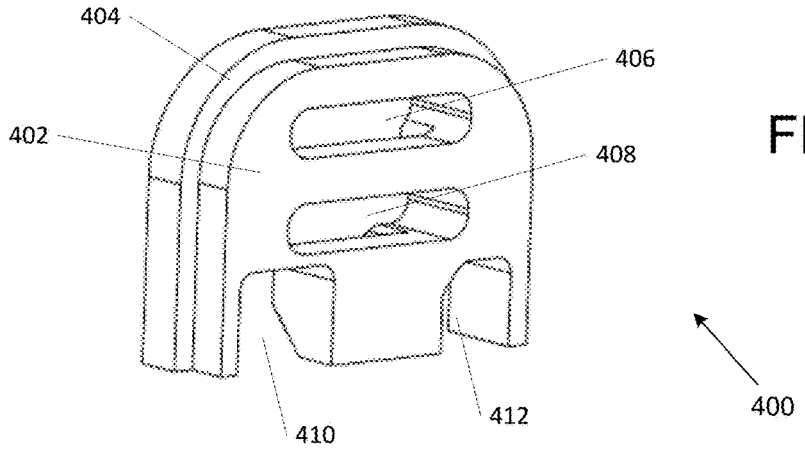
FIGS. 4A-B are schematic diagrams illustrating exterior and interior sides of a first plate, respectively, in accordance with an embodiment of the invention.
Figure 4B:
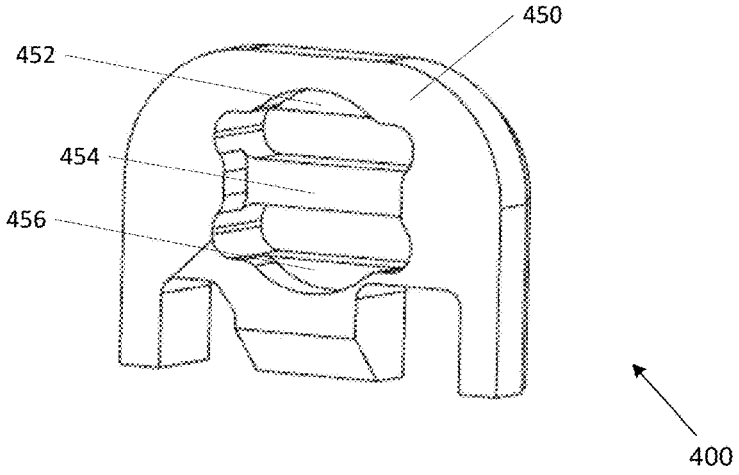

A slide cover plate assembly may include a first plate and a second plate. As discussed above, the first and second plates may be configured to mate such that manual pressure asserted by an operator allows the slide cover plate assembly to engage and/or disengage a slide of a pistol. Schematic diagrams illustrating an exterior and interior sides of a first plate in accordance with an embodiment of the invention is shown in FIGS. 4A and 4B, respectively. In reference to FIG. 4A, a first plate 400 may include an exterior face 402 and grooves 404 configured to mate with grooves of a slide as described above. In many embodiments, the first plate 400 may also include a first opening 406 and a second opening 408 that is configured to receive a second plate as further described below. In various embodiments, the first plate 400 may also include a first clearance notch 410 and a second clearance notch 412 configured to allow a slide to move along a frame of a pistol when the pistol is in operation. In reference to FIG. 4B, the first plate 400 may also include an interior face 450, a first contact portion 452, a second contact portion 454, and a third contact portion 456. In many embodiments, the contact portions 452, 454, 456 may be configured to mate with corresponding contact portions of a second plate as further described below.

Figure 4C:
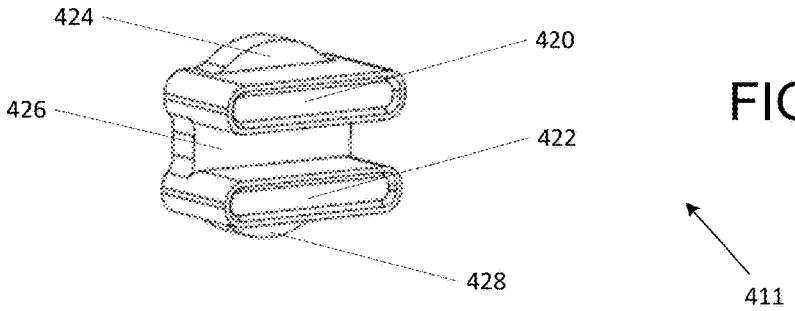
FIGS. 4C-D are schematic diagrams illustrating exterior and interior sides of a second plate, respectively, in accordance with an embodiment of the invention.
Figure 4D:
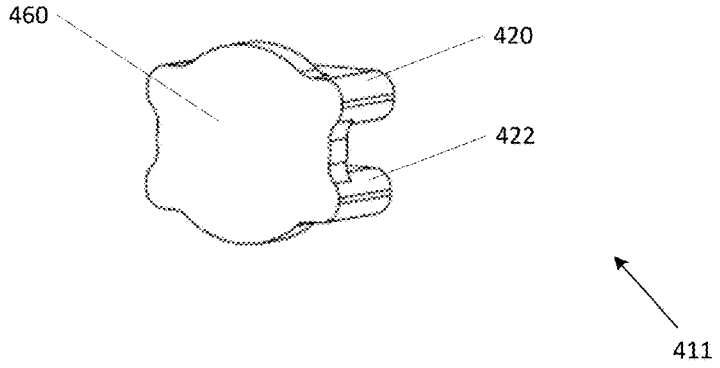

Schematic diagrams illustrating an exterior and interior sides of a second plate in accordance with an embodiment of the invention are shown in FIGS. 4C and 4D, respectively. In reference to FIG. 4C, a second plate 411 may include a first button 420 and a second button 422 configured to be inserted through the first opening 406 and second opening 408 of the first plate, respectively. In many embodiments, when the slide cover plate assembly is engaged, the first and second buttons 420, 422 may protrude out beyond the surface of the exterior face 402 allowing for an operator to apply manual pressure to the first button 420 and/or second button 422. In other embodiments, the first button 420 and/or second button 422 may be at the same surface level or below the surface level of the exterior face 402. In various embodiments, the second plate 411 may also include a first contact portion 424 that is configured to mate with the first contact portion 452 of the first plate 400. Likewise, the second plate 411 may include a second contact portion 426 that is configured to mate with the second contact portion 454 of the first plate 400. Further, the second plate 411 may include a third contact portion 428 that is configured to mate with the third contact portion 456 of the first plate 400. In reference to FIG. 4D, the second plate 411 may also include an interior face 460 that is configured to be in contact with a spacer sleeve and configured to receive force applied to the spacer sleeve from a compressed firing pin spring as described above. In other embodiments, the interior face 460 may receive force directly from the compressed firing pin spring. In many embodiments, the interior face 460 is on the opposite face of the second plate 411 from the first button 420 and the second button 422. In various embodiments, the force applied from the firing pin spring may be applied from the first 424, second 428, and third 426 contact portions of the second plate to the corresponding first 452, second 426, and third 428 contact portions of the first plate. As described above, the force from the compressed firing pin spring may allow for the slide cover plate assembly to engage with the slide, and force that is manually applied by an operator may allow the slide cover plate assembly to disengage from the slide as described above.

Figure 4E:
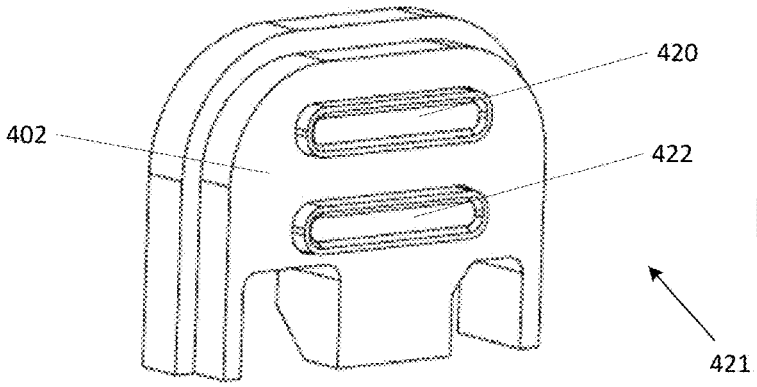
FIGS. 4E-F are schematic diagrams illustrating exterior and interior sides of a slide cover plate assembly, respectively, in accordance with an embodiment of the invention.
Figure 4F:
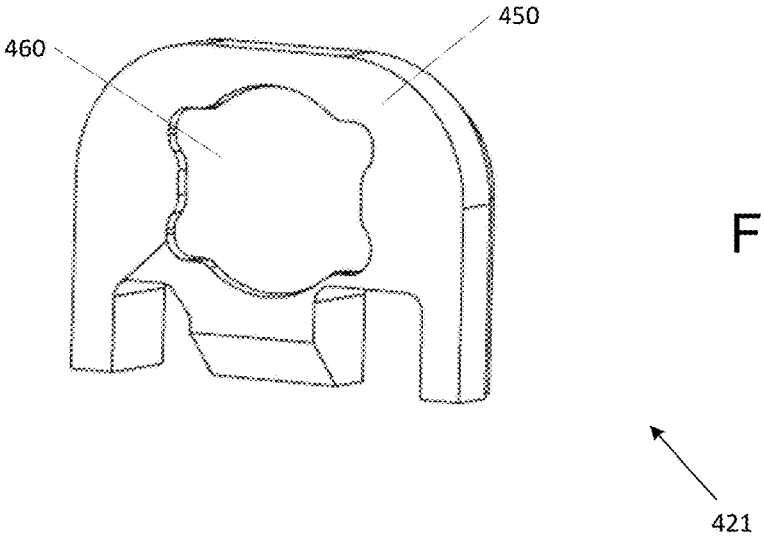

Schematic diagrams illustrating exterior and interior sides of a slide cover plate assembly in accordance with an embodiment of the invention are shown in FIGS. 4E and 4F, respectively. In reference to FIG. 4E, a slide cover plate assembly 421 may include a first plate and a second plate. When the slide cover plate assembly 421 is engaged with a rear portion of a slide, the first button 420 and the second button 422 may be exposed along with the exterior face 402 of the first plate. An operator may apply manual pressure to the first button 420 and/or the second button 422 to disengage the slide cover plate assembly 421 from a slide as described above. In reference to FIG. 4F, in many embodiments, the first and second plates may be configured so that a spacer sleeve is only in contact with the interior face 460 of the second plate and not with the interior face 450 of the first plate.

Schematic diagrams illustrating a slide cover plate assembly in accordance with an embodiment of the invention are shown in FIGS. 5A-5F. In reference to FIG. 5A, a first plate 500 may include an exterior face 502 and grooves 504 configured to mate with grooves of a slide as described above. In many embodiments, the first plate 500 may also include an opening 506 that is configured to receive a second plate as further described below. In various embodiments, the first plate 500 may also include a first clearance notch 508 and a second clearance notch 510 configured to allow a slide to move along a frame of a pistol when the pistol is in operation. In reference to FIG. 5B, the first plate 500 may also include an interior face 550, a first contact portion 552, and a second contact portion 554. In many embodiments, the contact portions 552, 554 may be configured to mate with corresponding contact portions of a second plate as further described below.

Figure 5A:
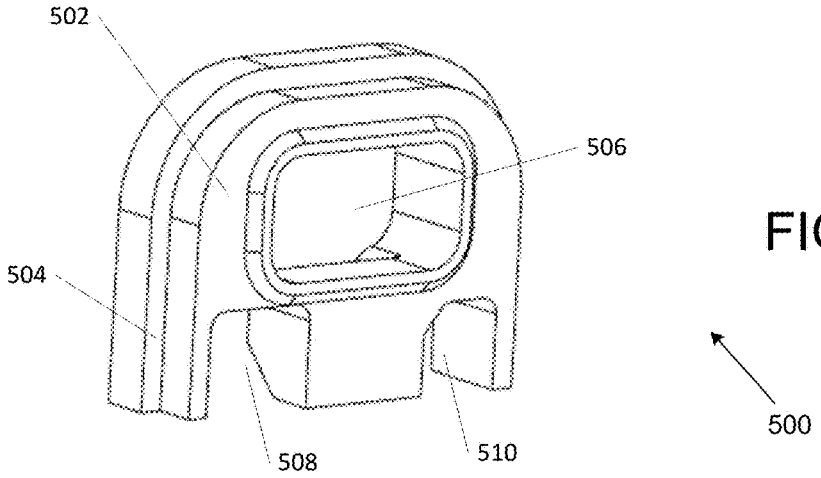
FIGS. 5A-B are schematic diagrams illustrating exterior and interior sides of a first plate, respectively, in accordance with an embodiment of the invention.
Figure 5B:
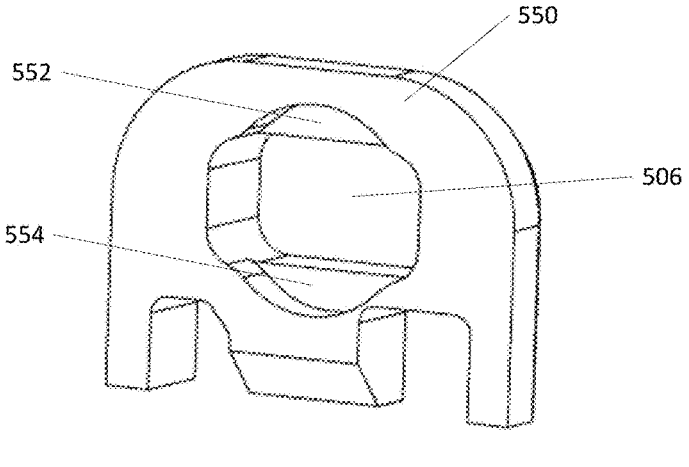
Figure 5C:
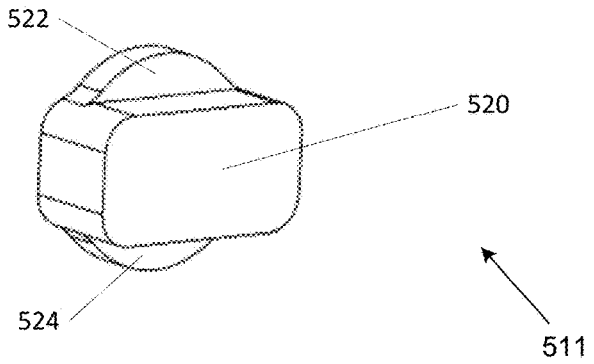
FIGS. 5C-D are schematic diagrams illustrating exterior and interior sides of a second plate, respectively, in accordance with an embodiment of the invention.
Figure 5D:
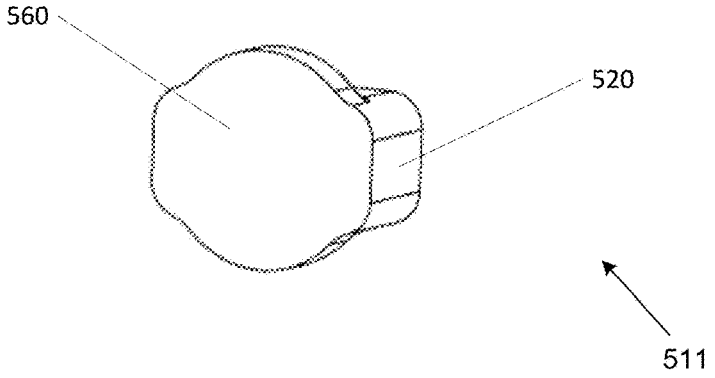

Schematic diagrams illustrating exterior and interior sides of a second plate in accordance with an embodiment of the invention are shown in FIGS. 5C and 5D, respectively. In reference to FIG. 5C, a second plate 511 may include a button 520 configured to be inserted through the opening 506 of the first plate 500. In many embodiments, when the slide cover plate assembly is engaged, the button 520 may protrude above the surface of the exterior face 502 of the first plate 500 allowing for an operator to apply manual pressure to the button 520. In other embodiments, the button 520 may be on the same surface level or below the surface level of the exterior face 502 of the first plate 500. In various embodiments, the second plate 511 may also include a first contact portion 522 that is configured to mate with the first contact portion 552 of the first plate 500. Likewise, the second plate 511 may include a second contact portion 524 that is configured to mate with the second contact portion 554 of the first plate 500. In reference to FIG. 5D, the second plate 511 may also include an interior face560 that is in contact with a spacer sleeve and configured to receive force applied to the spacer sleeve from a compressed firing pin spring as described above. In many embodiments, the interior face560 is on the opposite face of the second plate 511 from the button 520. In various embodiments, the force applied from the firing pin spring may be applied from the first 522 and second 524 contact portions of the second plate 511 onto the corresponding first 552 and second 554 contact portions of the first plate 500. As described above, the force from the compressed firing pin spring may allow for the slide cover plate assembly with engage to the slide, and force that is manually applied by an operator may allow the cover plate assembly to disengage from the slide as described above.

Figure 5E:
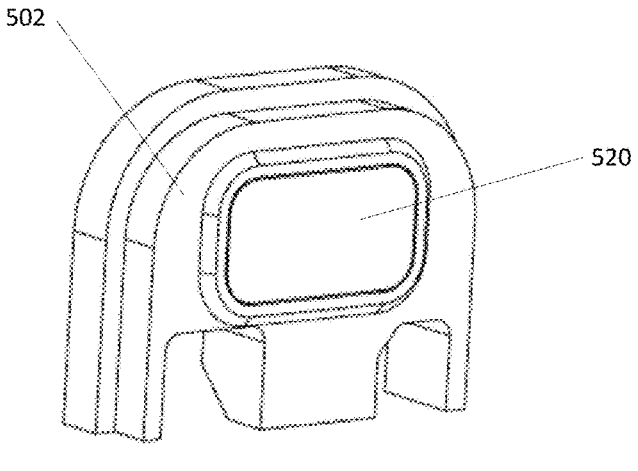
FIGS. 5E-F are schematic diagrams illustrating exterior and interior sides of a slide cover plate assembly, respectively, in accordance with an embodiment of the invention.
Figure 5F:
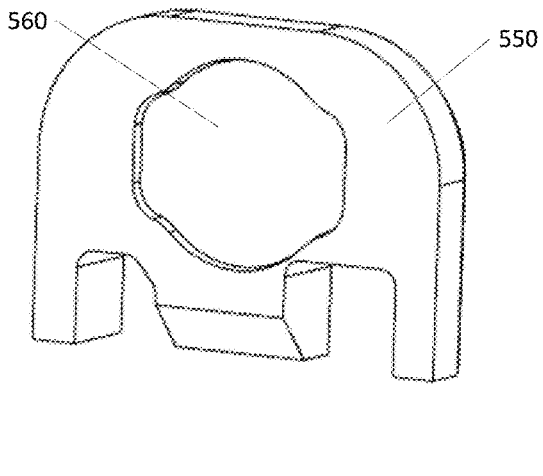

Schematic diagrams illustrating exterior and interior sides of a slide cover plate assembly in accordance with an embodiment of the invention are shown in FIGS. 5E and 5F, respectively. In reference to FIG. 5E, a slide cover plate assembly 521 may include a first plate and a second plate. When the slide cover plate assembly 521 is engaged with a rear portion of a slide, the button 520 may be exposed along with the exterior face 502 of the first plate. An operator may apply manual pressure to the button 520 to disengage the slide cover plate assembly 521 from a slide as described above. In reference to FIG. 5F, in many embodiments, the first and second plates may be configured so that a spacer sleeve is only in contact with the interior face560 of the second plate and not with the interior face 550 of the first plate.

Figure 6A:
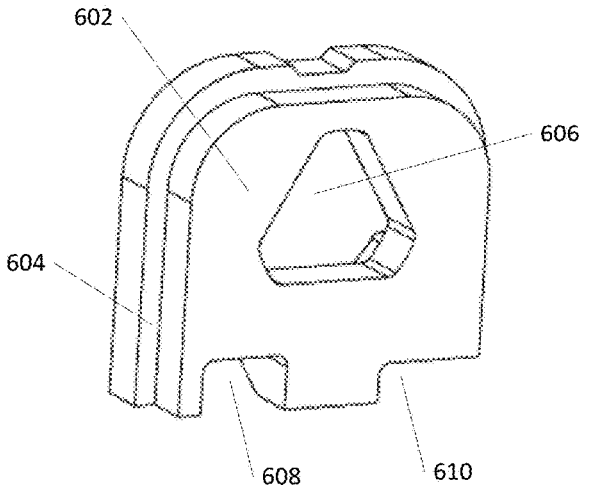
FIGS. 6A-B are schematic diagrams illustrating exterior and interior sides of a first plate, respectively, in accordance with an embodiment of the invention.
Figure 6B:
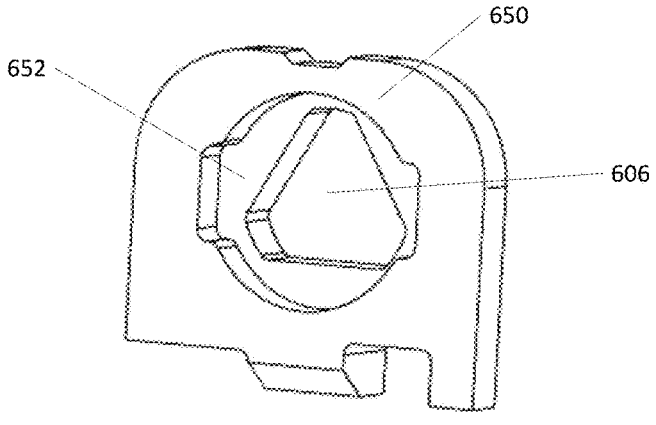

Schematic diagrams illustrating exterior and interior sides of a first plate in accordance with an embodiment of the invention are shown in FIGS. 6A and 6B, respectively. In reference to FIG. 6A, a first plate 600 may include an exterior face 602 and grooves 604 configured to mate with grooves of a slide as described above. In many embodiments, the first plate 600 may also include an opening 606 that is configured to receive a second plate as further described below. In various embodiments, the first plate 600 may also include a first clearance notch 608 and a second clearance notch 610 configured to allow a slide to move along a frame of a pistol when the pistol is in operation. In reference to FIG. 6B, the first plate 600 may also include an interior face 650 and a contact portion 652. In many embodiments, the contact portion 652 may be configured to mate with a corresponding contact portion of a second plate as further described below.

Figure 6C:
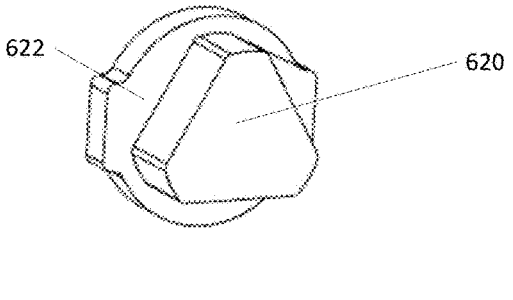
FIGS. 6C-D are schematic diagrams illustrating exterior and interior sides of a second plate, respectively, in accordance with an embodiment of the invention.
Figure 6D:
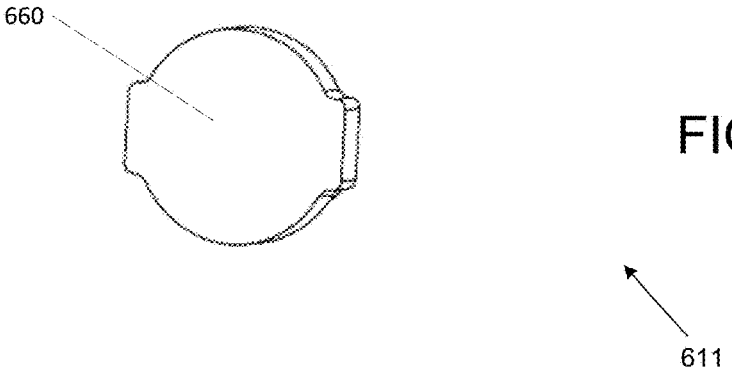

Schematic diagrams illustrating exterior and interior sides of a second plate, in accordance with an embodiment of the invention are shown in FIGS. 6C and 6D, respectively. In reference to FIG. 6C, a second plate 611 may include a button 620 configured to be inserted through the opening 606 of the first plate 600. In many embodiments, when the slide cover plate assembly is engaged, the button 620 may protrude above the surface of the exterior face 602 of the first plate 600 allowing for an operator to apply manual pressure to the button 620. In other embodiments, the button 620 may be on the same surface level or below the surface level of the exterior face602 of the first plate 600. In various embodiments, the second plate 611 may also include a contact portion 622 that is configured to mate with the contact portion 652 of the first plate 600. In reference to FIG. 6D, the second plate 611 may also include an interior face660 that is in contact with a spacer sleeve and configured to receive force applied to the spacer sleeve from a compressed firing pin spring as described above. In many embodiments, the interior face660 is on the opposite face of the second plate 611 from the button 620. In various embodiments, the force applied from the firing pin spring may be applied from the contact portion 622 of the second plate 611 onto the corresponding contact portion 652 of the first plate 600. As described above, the force from the compressed firing pin spring may allow for the slide cover plate assembly to engage with the slide, and force that is manually applied by an operator may allow the cover plate assembly to disengage from the slide as described above.

Figure 6E:
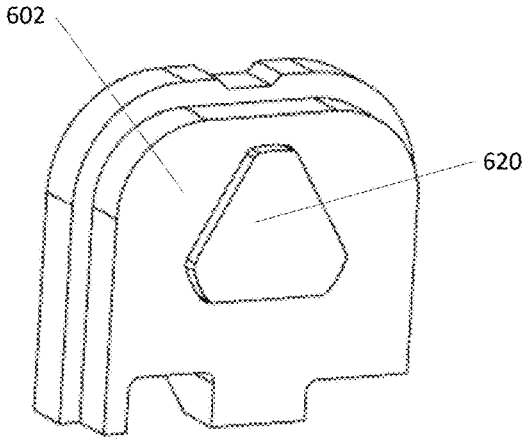
FIGS. 6E-F are schematic diagrams illustrating exterior and interior sides of a slide cover plate assembly, respectively, in accordance with an embodiment of the invention.
Figure 6F:
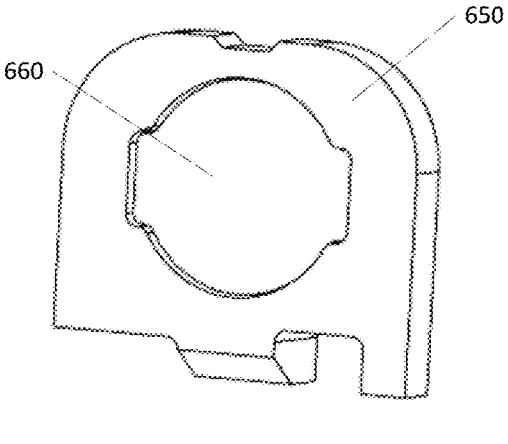

Schematic diagrams illustrating exterior and interior sides of a slide cover plate assembly in accordance with an embodiment of the invention are shown in FIGS. 6E and 6F, respectively. In reference to FIG. 6E, a slide cover plate assembly 621 may include a first plate and a second plate. When the slide cover plate assembly 621 is engaged with a rear portion of a slide, the button 620 may be exposed along with the exterior face602 of the first plate. An operator may apply manual pressure to the button 620 to disengage the slide cover plate assembly 621 from a slide as described above. In reference to FIG. 6F, in many embodiments, the first and second plates may be configured so that a spacer sleeve is only in contact with the interior face 660 of the second plate and not with the interior face650 of the first plate.

Although specific slide cover plate assemblies having first and second plates are discussed above with respect to FIGS. 4A-6F, any of a variety of slide cover plate assemblies including (but not limited to) slide cover plate assemblies where the first and second plates are configured to operate as a single unitary piece as appropriate to the requirements of a specific application can be used in accordance with embodiments of the invention. While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A slide cover plate assembly for accessing internal components housed within a slide of a pistol, comprising:

a first plate having an opening to mate with a button of a second plate;

the first plate comprising an interior face, at least one contact portion and a mating portion, wherein the mating portion is in contact with the slide;

the second plate comprising the button, a corresponding contact portion, and an interior face, wherein the interior face of the second plate receives a force exerted by a firing pin spring housed within the slide and the interior face of the second plate is flush with the interior face of the first plate;

wherein the contact portion of the first plate is in contact with the corresponding contact portion of the second plate allowing the second plate to transfer the force exerted by the firing pin to the first plate;

wherein the mating portion of the first plate in contact with the slide and uses the force transferred to the first plate from the second plate to engage the slide cover plate with the slide; and wherein the button receives a manual pressure applied by an operator, wherein the received manual pressure counteracts the force exerted by the firing pin allowing the slide cover plate assembly to disengage from the slide.

2. The slide cover plate assembly of claim 1, wherein the interior face of the second plate is in contact with a spacer sleeve housed within the slide.

3. The slide cover plate assembly of claim 2, wherein the interior face of the second plate receives the force exerted by the firing pin spring from the spacer sleeve housed within the slide.

4. The slide cover plate assembly of claim 1, wherein the button of the second plate protrudes above an exterior face of the first plate when the slide cover plate is engaged with the slide.

5. The slide cover plate assembly of claim 1, wherein the first plate further comprises a first clearance slot that allows the slide to move about a frame of the pistol.

6. The slide cover plate assembly of claim 5, wherein the first plate further comprises a second clearance slot that allows the slide to move about the frame of the pistol.

7. The slide cover plate assembly of claim 1, wherein the mating portion of the first plate is a groove and makes contact with a corresponding groove of the slide.

8. The slide cover plate assembly of claim 1, wherein the interior face of the second plate is below flush with the interior face of the first plate when the interior face of the second plate receives the force exerted by the firing pin spring housed within the slide.

9. The slide cover plate assembly of claim 1, wherein the interior face of the second plate is above flush with the interior face of the first plate when the button receives the manual pressure applied by the operator.

10. The slide cover plate assembly of claim 9, wherein the slide cover plate assembly is allowed to disengage from the slide when the interior face of the second plate is above flush with the interior face of the first plate.

11. A method for accessing internal components housed within a slide of a pistol using a slide cover plate assembly, the method comprising:

mating an opening of a first plate with a button of a second plate;

receiving a force exerted by a firing pin spring housed within the slide using an interior face of the second plate, wherein the interior face of the second plate is flush with an interior face of the first plate;

transferring the force exerted by the firing pin from the second plate to the first plate using a contact portion of the first plate in contact with a corresponding contact portion of the second plate;

engaging the slide cover plate assembly with the slide using a mating portion of the first plate, wherein the mating portion is in contact with the slide and engages the slide cover plate assembly with the slide using the force transferred to the first plate from the second plate; and receiving a manual pressure applied by an operator using the button of the second plate, wherein the received manual pressure counteracts the force exerted by the firing pin allowing the slide cover plate assembly to disengage from the slide.

12. The method of claim 11, wherein the interior face of the second plate is in contact with a spacer sleeve housed within the slide.

13. The method of claim 12, wherein the interior face receives the force exerted by the firing pin spring from the spacer sleeve housed within the slide.

14. The method of claim 11, wherein the button of the second plate protrudes above an exterior face of the first plate when the slide cover plate is engaged with the slide.

15. The method of claim 11, wherein the first plate further comprises a first clearance slot that allows the slide to move about a frame of the pistol.

16. The method of claim 15, wherein the first plate further comprises a second clearance slot that allows the slide to move about the frame of the pistol.

17. The method of claim 11, wherein the mating portion of the first plate is a groove and makes contact with a corresponding groove of the slide.

18. The method of claim 11, wherein the interior face of the second plate is below flush with the interior face of the first plate when the interior face of the second plate receives the force exerted by the firing pin spring housed within the slide.

19. The method of claim 11, wherein the interior face of the second plate is above flush with the interior face of the first plate when the button receives the manual pressure applied by the operator.

20. The method of claim 19, wherein the slide cover plate assembly is allowed to disengage from the slide when the interior face of the second plate is above flush with the interior face of the first plate.

* * * * *